US009507323B2

(12) United States Patent
Graemiger et al.

(10) Patent No.: US 9,507,323 B2
(45) Date of Patent: Nov. 29, 2016

(54) CLOCK MECHANISM FOR STORING AND DISPLAYING TIME INFORMATION

(71) Applicant: ROLEX SA, Geneva (CH)

(72) Inventors: Pierre-Alain Graemiger, Trelex (CH); Frédéric Oulevey, Saint-George (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/291,542

(22) Filed: May 30, 2014

(65) Prior Publication Data

US 2014/0355393 A1 Dec. 4, 2014

(30) Foreign Application Priority Data

May 31, 2013 (EP) ..... 13170111

(51) Int. Cl.
*G04F 7/08* (2006.01)

(52) U.S. Cl.
CPC ..... *G04F 7/0823* (2013.01); *G04F 7/0871* (2013.01); *G04F 7/088* (2013.01); *G04F 7/0847* (2013.01)

(58) Field of Classification Search
CPC ..... G04F 7/08–7/0895
See application file for complete search history.

(56) References Cited

U.S. PATENT DOCUMENTS

| | | | | |
|---|---|---|---|---|
| 5,220,541 | A * | 6/1993 | Vuilleumier | 368/88 |
| 6,466,518 | B1 * | 10/2002 | Akahane et al. | 368/64 |
| 6,567,345 | B1 * | 5/2003 | Furukawa et al. | 368/80 |
| 6,975,561 | B2 * | 12/2005 | Forsey et al. | 368/10 |
| 7,014,356 | B2 | 3/2006 | Bobe et al. | |
| 7,029,169 | B2 * | 4/2006 | Takahashi et al. | 368/106 |
| 7,918,602 | B2 * | 4/2011 | Wyssbrod | 368/106 |
| 8,179,744 | B2 * | 5/2012 | Laucella | G04B 19/02 368/110 |
| 2003/0137900 | A1 * | 7/2003 | Akahane et al. | 368/110 |
| 2004/0052162 | A1 * | 3/2004 | Takahashi | 368/101 |
| 2005/0249043 | A1 | 11/2005 | Bobe et al. | |
| 2008/0253235 | A1 | 10/2008 | Hiraga | |
| 2009/0310445 | A1 | 12/2009 | Laucella et al. | |
| 2012/0020192 | A1 | 1/2012 | Calabrese | |
| 2013/0100781 | A1 | 4/2013 | Richard | |

FOREIGN PATENT DOCUMENTS

| | | |
|---|---|---|
| CH | 682201 A | 8/1993 |
| CH | 682201 A3 | 8/1993 |
| CH | 703 470 A2 | 1/2012 |
| EP | 1 372 117 A1 | 12/2003 |

(Continued)

OTHER PUBLICATIONS

European Search Report dated Dec. 19, 2013 issued in corresponding application No. EP13170111.
Office Action dated Dec. 31, 2015, issued in co-pending U.S. Appl. No. 14/291,554 (8 pages).

(Continued)

*Primary Examiner* — Amy Cohen Johnson
*Assistant Examiner* — Jason Collins
(74) *Attorney, Agent, or Firm* — Westerman, Hattori, Daniels & Adrian, LLP

(57) ABSTRACT

A mechanism (3) for indicating and storing time information, the mechanism including a member (H) for displaying the hours, and/or a member (M) for displaying the minutes, and/or a member (S) for displaying the seconds, and a member (H') for displaying the stored hours, and/or a member (M') for displaying the stored minutes, and a member (S') for displaying the stored seconds.

25 Claims, 9 Drawing Sheets

(56) References Cited

FOREIGN PATENT DOCUMENTS

| | | | |
|---|---|---|---|
| EP | 1 475 681 | A1 | 11/2004 |
| EP | 1 584 997 | A2 | 10/2005 |
| EP | 2 136 271 | A1 | 12/2009 |
| EP | 2 410 388 | A1 | 1/2012 |
| WO | 2011/131788 | A1 | 10/2011 |

OTHER PUBLICATIONS

European Search Report dated Dec. 19, 2013 issued in European application No. EP13170125, counterpart of co-pending U.S. Appl. No. 14/291,554 (w/ English translation) (4 pages).
Office Action dated Jun. 19, 2015, issued in co-pending U.S. Appl. No. 14/291,554 (12 pages).

* cited by examiner

CLOCK MECHANISM FOR STORING AND DISPLAYING TIME INFORMATION

The invention relates to a clock mechanism for storing time information. The invention also relates to a clock movement comprising such a mechanism for storing time information. The invention further relates to a timepiece, notably a watch, comprising such a movement or such a mechanism.

Devices for storing time information, notably seconds, are known from the prior art. A split-time chronograph is a known example of this.

In this type of chronograph, a second secondhand, commonly referred to as a flyback hand, is superposed on the sweeping hand of the chronograph. When the chronograph pushbutton for starting the stopwatch is pressed, the flyback hand remains superposed on the sweeping hand. A first press of the split-time pushbutton causes the flyback hand to stop, while the sweeping hand continues its sweep. A second press of the split-time pushbutton returns the flyback hand to the sweeping hand.

Such a device is described for example in the work by B. Humbert entitled "Le chronographe [the chronograph]" (chapter 13) or in patent CH682201. In addition to the conventional chronograph mechanism, the device in patent CH682201 uses a control system designed to control a flyback mobile which consists of a control cam able to rotate, notably a column wheel, and of a pair of immobilizing clamps.

Aside from the fact of employing a considerable number of components, notably a complex chronograph engagement device which allows the flyback mobile to be connected selectively to the geartrain of the basic movement, the main disadvantage with the conventional split-time chronograph is that it is unable to store times in excess of one minute. To overcome this shortcoming, patent application EP1584997 discloses a split-time chronograph that allows the seconds and minutes of a timed period to be stored. Thus, the storage capability of the split-time function is no longer limited to sixty seconds but extended to the number of minutes which are displayed by the minutes counter of the chronograph, thirty minutes in that instance. This device uses a minutes flyback mobile the particular feature of which is that it is actuated by the same column wheel as is used to actuate the seconds flyback mobile. Such a solution is appropriate because the two flyback mobiles are positioned on one and the same side of the frame of the timepiece. However, this system does have two disadvantages. First, the storage mechanism is dependent on the chronograph mechanism in so far as the minutes flyback mobile is kinematically connected to the counting geartrain of the chronograph. Second, the storage capability of the device remains limited to the number of minutes displayed by the minutes counter of the chronograph.

It would therefore seem that there does not exist any mechanism for storing a time or a timing to within a second that has the ability to store times longer than one hour, or even longer than thirty minutes.

It is an object of the invention to provide a clock mechanism that overcomes the abovementioned disadvantages and is able to improve clock mechanisms known from the prior art. In particular, the invention proposes a clock mechanism and a clock movement that are simple and reliable allowing the display of a timing that is stored to within a second, or even to within a fraction of a second.

According to a first aspect of the invention, the mechanism for indicating and storing time information comprises:

a member for displaying the hours, and/or
a member for displaying the minutes, and/or
a member for displaying the seconds, and
a member for displaying the stored hours, and/or
a member for displaying the stored minutes, and
a member for displaying the stored seconds.

The mechanism may comprise a first device for storing the seconds and at least a second device for storing the minutes and/or the hours.

The first storage device may comprise a first storage mobile provided with a first storage element intended to be in mesh with a geartrain devoted to said first mobile and/or the second storage device may comprise a second storage mobile provided with a second storage element intended to be in mesh with a geartrain devoted to said second mobile.

The first storage device may comprise a first immobilizing device, notably at least a first clamp or a first lever, and/or the second storage device may comprise a second immobilizing device, notably at least a second clamp or a second lever.

The mechanism may comprise a control element for operating the first storage device and the second storage device.

The control element may comprise:

a first cam, notably a first column wheel, for operating the first member; and
a second cam, notably a second column wheel, for operating the second member.

The first cam or the first column wheel and the second cam or the second column wheel may be connected by an arbor, notably the first cam or the first column wheel and the second cam or the second column wheel may be fixed together by an arbor.

The mechanism may allow a 12-hour or even a 24-hour display.

The member for displaying stored minutes and/or the member for displaying stored hours may be configured in order to allow a storage capacity greater than 30 minutes, even greater than or equal to one hour, even greater than or equal to 6 hours, even greater than or equal to 12 hours, even equal to 24 hours. In such a way, a user action on the mechanism allows the storage of any current time information included in the capacity.

According to the first aspect of the invention, a clock movement comprises a mechanism defined hereinabove. The first storage device comprises a first storage element in mesh with an element of a geartrain of the clock movement or fixed to an element of a geartrain of the clock movement, and/or a second storage device comprises a second storage element in mesh with a motion-work.

The geartrain element may be a seconds wheel.

The first storage element may be a cam, notably a heart piece, and/or the second storage element may be a cam, notably a heart piece.

The mechanism may have a median plane parallel to the plane of the frame of the movement and dividing the movement into a first part and a second part of substantially equal bulk, and the first storage device may be in the first part and the second storage device may be in the second part.

Cams may also be positioned on either side of the median plane.

According to the first aspect of the invention, a timepiece, notably a watch, particularly a wristwatch, comprises a movement defined hereinabove or a mechanism defined hereinabove.

According to a second aspect of the invention which complements or takes the place of the first aspect of the invention, a clock movement comprises a mechanism for indicating and storing time information. The mechanism comprises a member for displaying the stored seconds and/or stored fractions of seconds and a first storage device for storing the seconds and/or fractions of seconds. The storage device comprises a first storage mobile equipped with a first storage element in direct mesh with an element of a geartrain of the clock movement or a first storage element fixed to an element of a geartrain of the clock movement.

Preferably, the first storage element is permanently in connection with an element of the geartrain of the clock movement.

The first geartrain element may be a seconds wheel.

The storage element may be a cam, notably a heart piece.

The first storage device may comprise a first immobilizing device, notably at least a first clamp or a first lever.

The mechanism may comprise:

- a member for displaying the hours and/or a member for displaying the minutes, and
- a member for displaying the stored hours and/or a member for displaying the stored minutes, and
- at least a second device for storing the minutes and/or the hours.

The second storage device may be provided with a second storage element in mesh with a motion-work.

The second storage element may comprise a heart piece.

The second storage device may comprise a second immobilizing device, notably at least a second clamp or a second lever.

The first and second immobilizing devices may be disposed in order to synchronize the stop:

- of the members (H', M') for displaying the stored hours and/or the stored minutes, and
- of the member (S') for displaying the stored seconds.

The movement may comprise cams disposed in order to synchronize the first and second immobilizing devices for the purpose of synchronizing the stop:

- of the members for displaying the stored hours and/or the stored minutes, and
- of the member for displaying the stored seconds.

The movement may have a median plane parallel to the plane of the frame of the movement and dividing the movement into a first part and a second part of substantially equal bulk, and the first storage device may be in the first part and the second storage device may be in the second part.

The movement may comprise a control element for operating the first storage device and the second storage device.

The control element may comprise:

- a first cam, notably a first column wheel, for operating the first member; and
- a second cam, notably a second column wheel, for operating the second member.

The first cam or the first column wheel and the second cam or the second column wheel may be connected by an arbor, notably the first cam or the first column wheel and the second cam or the second column wheel may be fixed together by an arbor.

The cams may be positioned on either side of the median plane.

The movement may allow a 12-hour or even a 24-hour display.

The member for displaying stored minutes and/or the member for displaying stored hours may be disposed in order to allow a storage capacity greater than 30 minutes, even greater than or equal to one hour, even greater than or equal to 6 hours, even greater than or equal to 12 hours, even equal to 24 hours. In such a way, a user action on the mechanism allows the storage of any current time information included in the capacity.

According to the second aspect of the invention, a timepiece, notably a watch, particularly a wristwatch, comprises a movement defined hereinabove.

The attached drawings depict, by way of example, one embodiment of a clock mechanism according to the invention.

Figure 1:
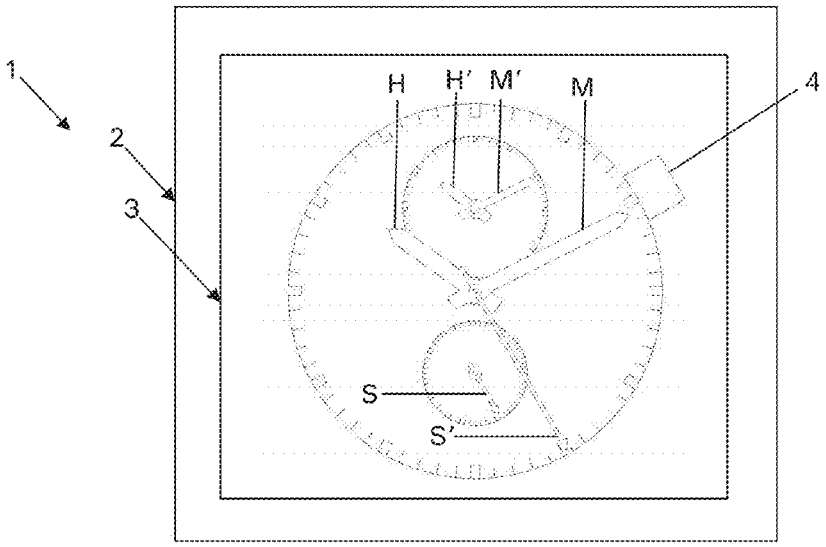
FIG. 1 is a schematic view of one embodiment of a timepiece according to the invention in a first operating configuration.

One embodiment of a timepiece 1 according to the invention is described hereinafter with reference to FIGS. 1 to 3. In this embodiment of timepiece, storage members H', M', S', notably additional hands, that can indicate or display stored hours, stored minutes and stored seconds are added to conventional indicating or display members H, M, S, notably conventional hands H, M, S. The timepiece is thus able to store a timing to within a second while at the same time indicating the current time. It is in particular able to display a timing to within a second in a time range extending over several hours, notably 12 hours or even 24 hours.

The timepiece is, for example, a watch, notably a wristwatch. The timepiece comprises a clock movement 2. The clock movement 2 for its part comprises a clock mechanism 3 which is described in detail later on. This clock mechanism 3 comprises for example display members H, M, S, H', M', S' able to indicate or display the current hours, minutes, seconds or even fractions of a second and to indicate or display the stored hours, minutes, seconds or even fractions of a second. The mechanism may for example comprise a member for indicating the current fractions of a second and/or a member for indicating the stored fractions of a second.

These indicating members may for example be operated by jumping seconds mechanisms. Thereafter, to simplify, only members that display hours, minutes and seconds will be considered, rather than members that display fractions of seconds.

In normal operation, as indicated in FIG. 1, the members H, M, S that display the current hours, minutes and seconds and the members H', M', S' that display the stored hours, minutes and seconds indicate the current time.

Figure 2:
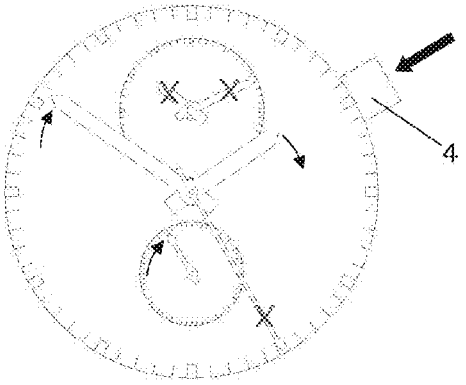
FIG. 2 is a schematic view of the embodiment of the timepiece according to the invention in a second operating configuration.

A first action on a control member 4, such as a pressing of a button, causes the members H', M', S' that display the stored hours, minutes and seconds to immobilize without having any effect on the members H, M, S that display the current hours, minutes and seconds which continue on their way, as indicated in FIG. 2. Thus, in this configuration, the members H', M', S' indicate stored time information.

Figure 3:
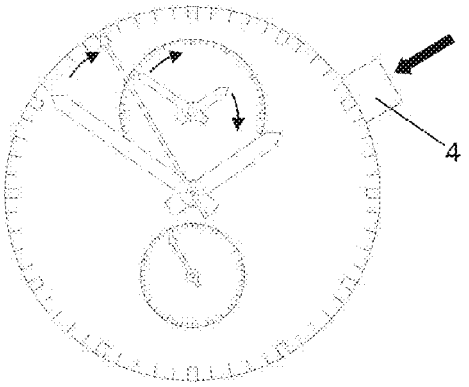
FIG. 3 is a schematic view of the embodiment of the timepiece according to the invention in a third operating configuration.

A second action on the control member 4, for example a pressing of the button, causes the members H', M', S' that display the stored hours, minutes and seconds to reposition or resynchronize with the members H, M, S that display the current hours, minutes and seconds, as indicated in FIG. 3. The members H', M', S' that display the stored hours, minutes and seconds and the members H, M, S that display the current hours, minutes and seconds are thus synchronized again. The members H', M', S' that display the stored hours, minutes and seconds and the members H, M, S that display the current hours, minutes and seconds therefore display the same information.

One embodiment of the clock mechanism 3 for indicating and storing time information is now described in greater detail with reference to FIGS. 4 to 17.

According to a first aspect of the invention, the mechanism 3 for indicating and storing time information comprises:

- a member H for displaying the hours and/or a member M for displaying the minutes and/or a member S for displaying the seconds or even a member for displaying the fractions of a second, and
- a member H' for displaying the stored hours and/or a member M' for displaying the stored minutes and/or a member S' for displaying the stored seconds or even a member for displaying the stored fractions of a second.

Advantageously, according to this first aspect of the invention, the mechanism comprises a first device MEM1 for storing the seconds or even for storing the fractions of a second and at least a second device MEM2 for storing the minutes and/or the hours.

According to a second aspect of the invention, the clock movement 2 comprises the mechanism 3 for indicating and storing time information, this mechanism including:

- a member S' for displaying the stored seconds and/or the stored fractions of a second,
- a first device MEM1 for storing the seconds and/or fractions of a second.

The first storage device MEM1 further comprises a first storage mobile M1 provided with a first storage element MC1 in direct mesh with an element 12 of a geartrain 11, 12, 13, 14, 15 of the clock movement or a first storage element fixed to an element of a geartrain of the clock movement.

Preferably, the first storage element is permanently in connection with the element 12 of the geartrain of the clock movement.

The mechanism may also comprise a member S for displaying the seconds and/or fractions of a second.

Figure 4:
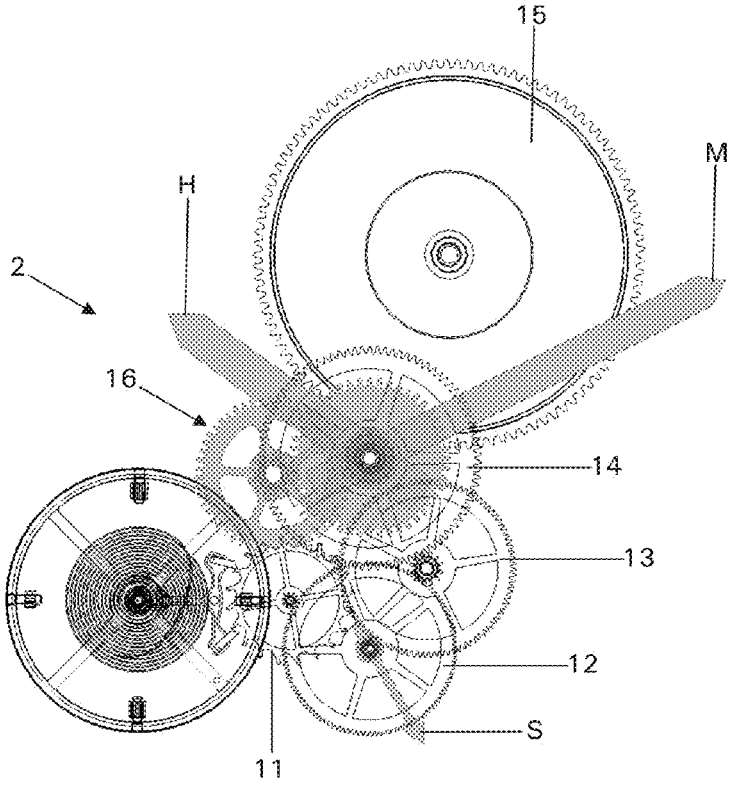
FIG. 4 is a partial view of one embodiment of a clock movement according to the invention.

The first storage device MEM1 provides an interface between the geartrain and the member S' for displaying the stored seconds, notably between a seconds wheel 12 and the member S' for displaying the stored seconds. As indicated in FIG. 4, the geartrain may comprise a barrel 15, for example a center wheel 14, for example a third wheel 13, a seconds wheel 12 and an escapement wheel 11. The geartrain may, from the barrel to the oscillator, exhibit an entirely conventional structure. Alternatively, the geartrain may comprise several barrels and more than three mobiles so as to provide the kinematic connection between the barrel or barrels and the escapement wheel.

The first storage device MEM1 is described hereinafter with reference to FIGS. 5 to 9. The first storage device comprises:

- a first storage mobile M1 provided with a first storage element MC1 intended to be in mesh with a geartrain 11, 12, 13, 14, 15 devoted to said mobile.

More specifically, the first storage device comprises, in addition to the first mobile M1:

- a pinion 1*a* secured to the seconds wheel 12 (and therefore secured to the seconds display member S) and in mesh with, notably meshing with, the first storage mobile M1, and
- a pinion 1*a*' secured to the stored seconds display member S' and in mesh with, notably meshing with, the first storage mobile M1.

Figure 5:
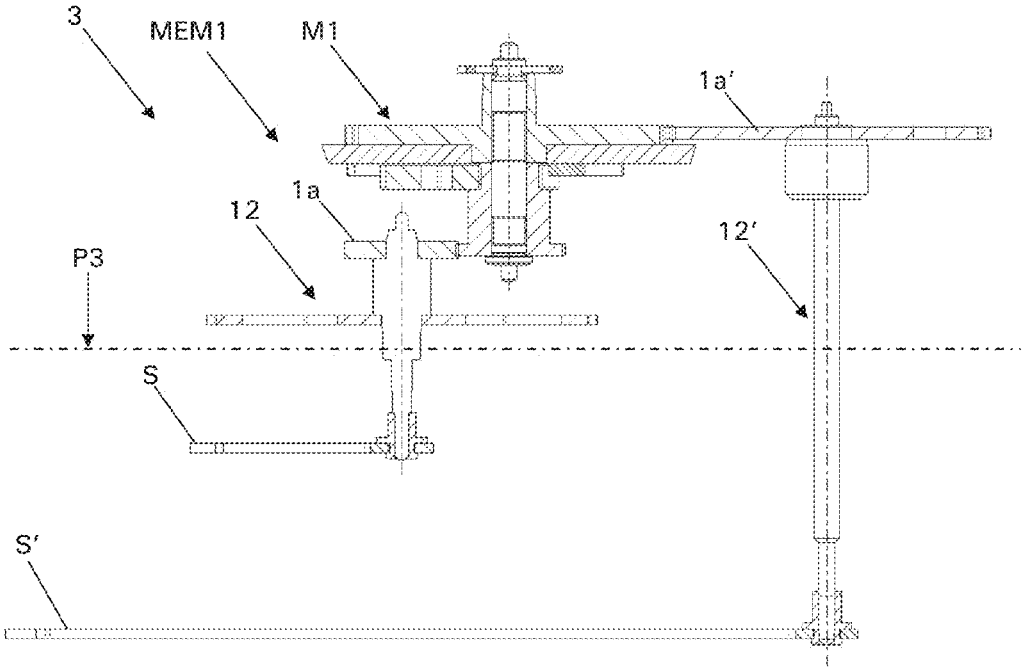
FIG. 5 is a view in partial section of one embodiment of a clock mechanism according to the invention.
Figure 6:
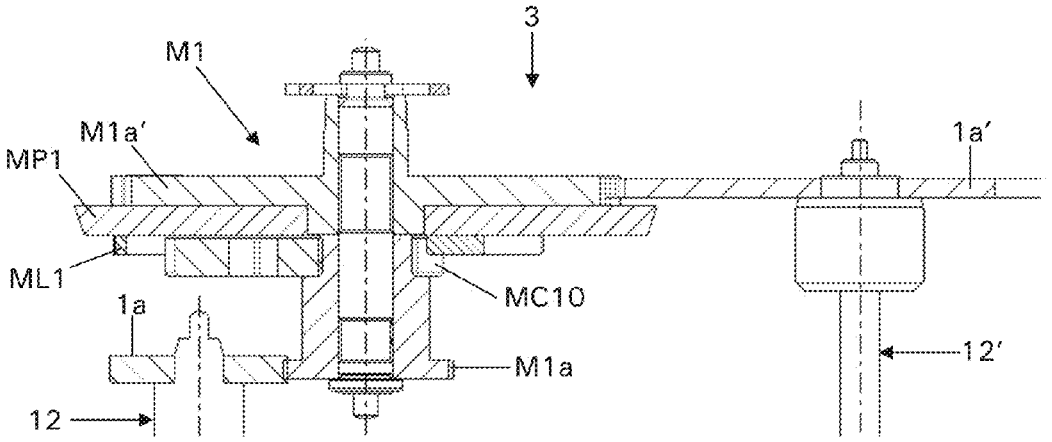
FIG. 6 is a view of a detail of FIG. 5 showing the embodiment of the clock mechanism according to the invention.

More specifically, the storage mobile M1 comprises a pinion M1*a* on which the first storage element MC1, which for example comprises a cam MC10, notably a heart piece, is mounted or fixed. This pinion M1*a* may be in continuous mesh with the pinion 1*a* of the seconds mobile 12. The storage mobile M1 comprises a wheel M1*a*' which is in mesh with the wheel 1*a*' of the mobile 12' on which the member S' that indicates the stored seconds is mounted or of which said member forms part, notably on which the storage hand S' is driven in. This wheel M1*a*' is also secured to a plate MP1 on which an elastic return lever ML1 pivots. The wheel M1*a*' and the plate MP1 are advantageously fixed to one another. The wheel 1*a*' and the stored seconds display member S' are connected by an arbor that passes right through the frame B of the movement 2 of the timepiece 1, as indicated in FIG. 5.

Figure 7:
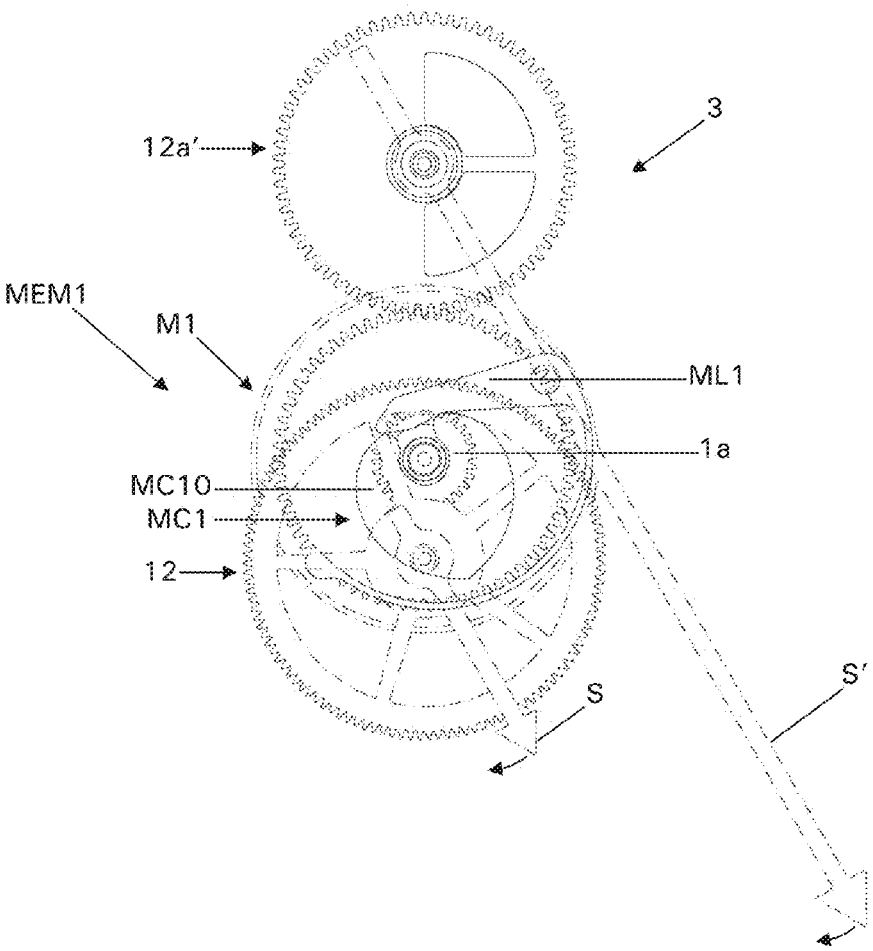
FIG. 7 is a partial plan view of a first display part of the embodiment of the clock mechanism according to the invention.

In normal or usual operation, namely when the seconds display member S and stored seconds display member S' are synchronized as in FIGS. 1 and 7, the head of the return lever ML1 presses against shoulders or hollows or the flat formed on the cam profile MC10. In this configuration, a control cam C1, notably a column wheel, is positioned in such a way that an immobilizing device B1 for immobilizing the plate MP1 is deactivated. In this configuration, the immobilizing device has no purchase on the plate MP1 and therefore on the storage mobile M1. Thus, the action of the return lever ML1 on the cam MC10 drives the plate MP1 and the cam MC10 in synchronous rotation thus causing the seconds member and the stored seconds member to display identically. The mechanism 3 comprises the control cam C1 for operating the first storage device.

Figure 8:
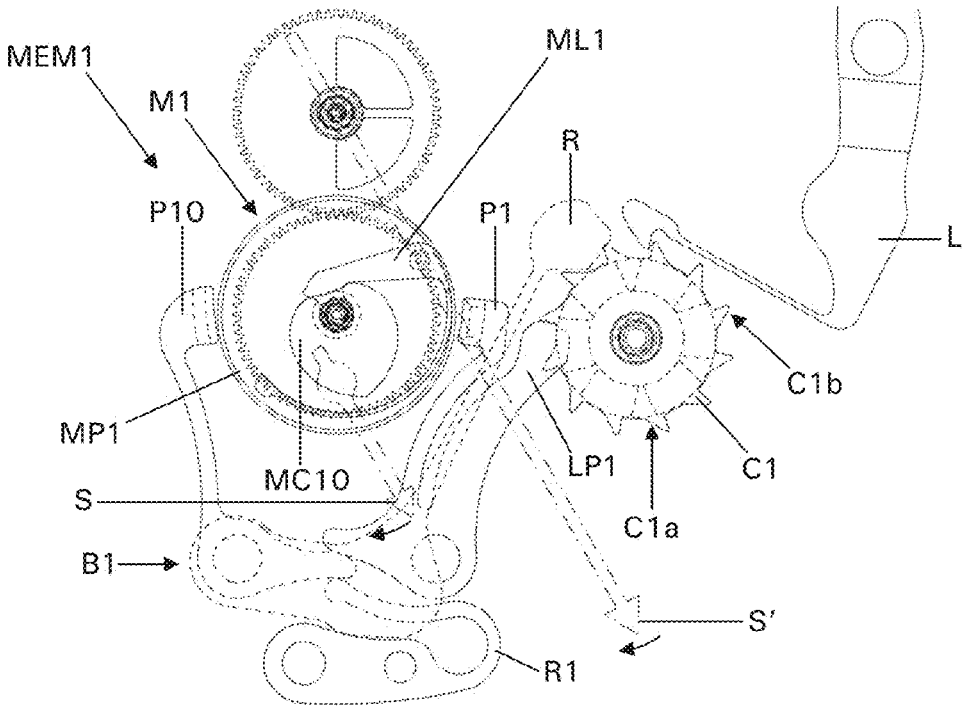
FIG. 8 is a view from above of a first storage part of the embodiment of the clock mechanism according to configuration of measuring time with a hand for indicating the stored seconds.
Figure 9:
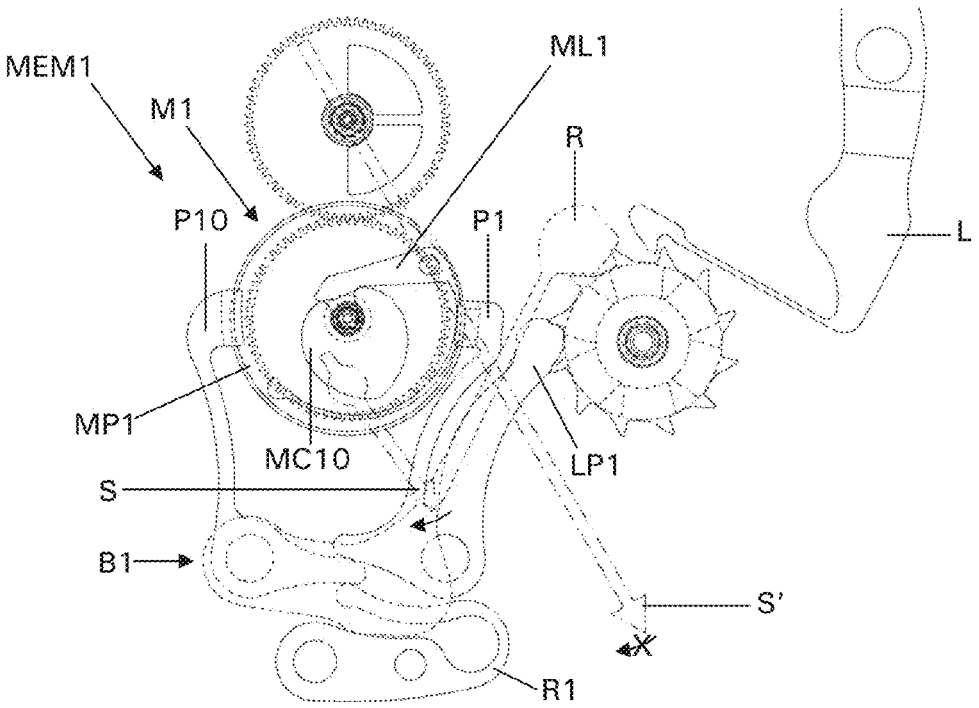
FIG. 9 is a view from above of the first storage part of the embodiment of the clock mechanism according to the invention, the mechanism being in a second configuration of storing time with the hand for indicating the stored seconds.
Figure 10:
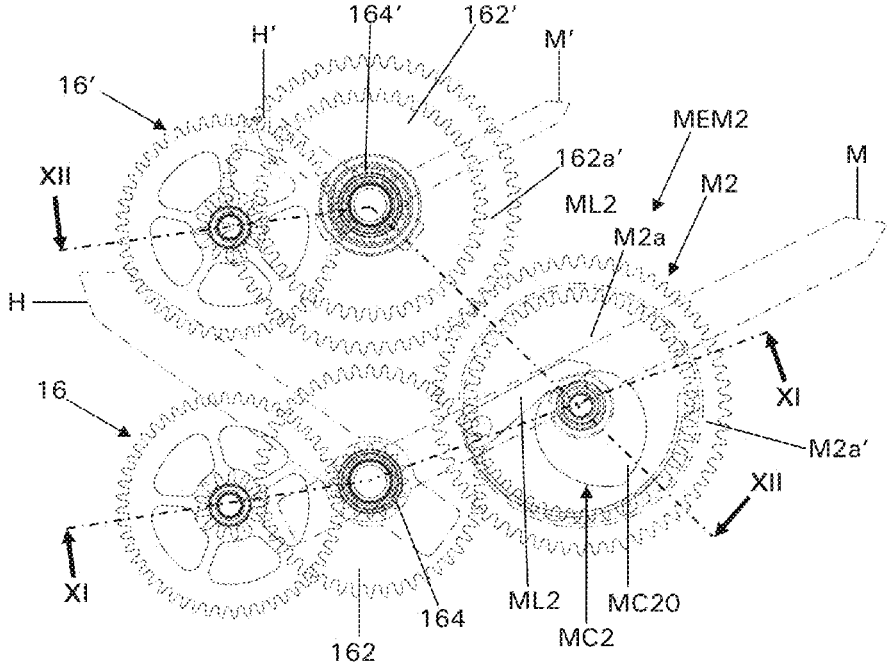
FIG. 10 is a partial plan view of a second display part of the embodiment of the clock mechanism according to the invention.

The immobilizing device B1 comprises at least one lever or clamp, preferably two levers or clamps P1 and P10 and a spring R1. The elements are arranged in such a way that they make the spring return the clamps away from the plate MP1 and therefore not immobilize the plate MP1 (as indicated in FIG. 8). The columns of the column wheel and a follower LP1 are designed to bring about contact of the clamps P1 and P10 with the plate MP1 when the follower LP1 is pressing against a column of the wheel (as indicated in FIG. 9). The display and storage mechanism comprises the immobilizing device B1.

Advantageously, the control cam C1 takes the form of a column wheel which is angularly indexed by a spring R. This wheel is, for example, provided with a binary profile C1*a* made up of columns and hollows. In the configuration of FIG. 8, the follower LP1 of the clamp P1 lies facing one of the hollows of the profile C1*a* so that the spring R1 positions the clamps P1 and P10 out of range of the plate MP1 on which the elastic return lever ML1 designed to collaborate with the cam MC10 pivots.

The control cam C1 may also be provided with a ratchet toothset C1*b* which is designed to be actuated and driven by one angular step by a lever L under the effect of a control member O. Pressure on the latter causes the control cam C1 to rotate so that one of the columns of the profile C1*a* drives the clamps P1, P10 against the action of the spring R1 so that they can immobilize the rotation of the plate MP1 of the mobile M1. Thus, in this configuration (indicated in FIG. 9), the lever ML1 is immobilized in a well defined angular position of the plate MP1, while the cam MC10 continues to turn. This situation results in the stored seconds display member S' being immobilized while the seconds display member S continues on its way. A further action on the control member O positions the control cam C1 in a configuration analogous to that of FIG. 9; the head of the lever ML1, under the effect of its elastic return element, then repositions itself against the shoulders, or hollows, or flat, of the cam MC10. Thus, the seconds display member S and the stored seconds display member S' are synchronized again. The mechanism 3 comprises the control member O. This control member allows action on the control cams C1, C2.

The second storage device MEM2 provides an interface between the members H, M that display the hours and minutes and the members H' and M' that display the stored hours and minutes.

The second storage device MEM2 is described hereinafter with reference to FIGS. 10 to 17. The second storage device comprises:

- a second storage mobile M2 provided with a second storage element MC2 intended to be in mesh with a geartrain 16 dedicated to said mobile.

More specifically, the second storage device comprises, in addition to the second mobile M2, an auxiliary motion-work connecting the member H' for displaying the stored hours and the member M' for displaying the stored minutes, notably in mesh, with the second storage mobile M2.

More specifically, the second storage mobile M2 comprises a wheel M2*a* on which the second storage element comprising for example a cam MC20, notably a heart piece, is mounted or fixed. This wheel M2*a* may be in continuous mesh with an hours wheel 162 which bears the member H that displays the hours. The storage mobile M2 comprises a wheel M2*a*' which is in mesh with a wheel 162*a*' secured to the wheel 162' which bears the stored hours display member H'. This wheel M2*a*' is also secured to a plate MP2 on which an elastic return lever ML2 pivots. The wheel M2*a*' and the plate MP2 are advantageously fixed to one another.

The second storage device is similar to the first storage device. Thus, the members H and M that display the hours and minutes are connected to the members H' and M' that display the stored hours and minutes via the intermediary of the second storage mobile M2.

Figure 11:
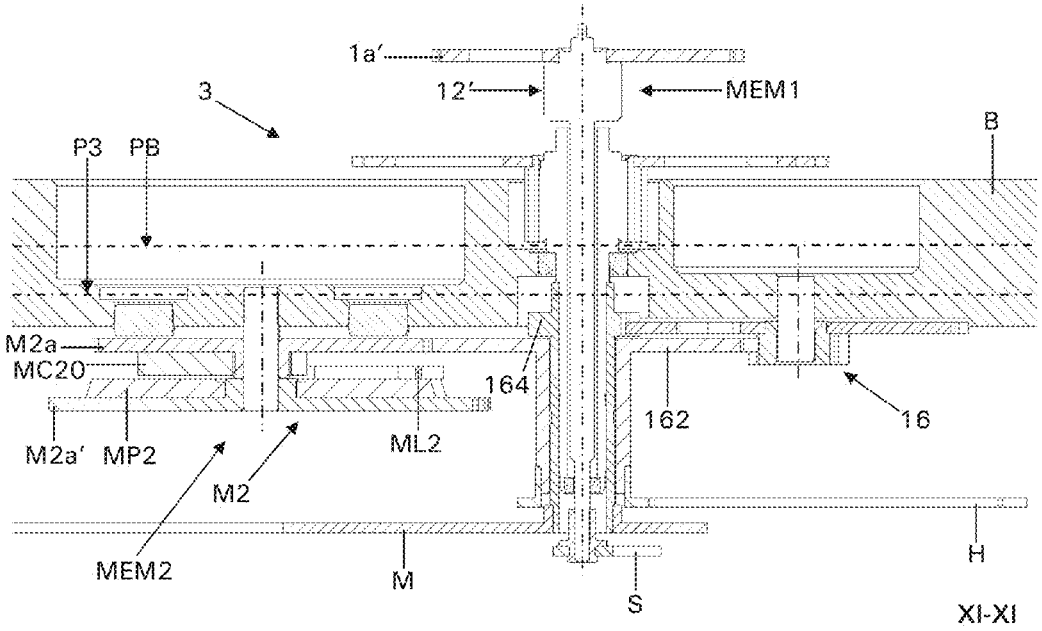
FIG. 11 is a view in section on XI-XI of FIG. 10 of the embodiment of the clock mechanism according to the invention.
Figure 12:
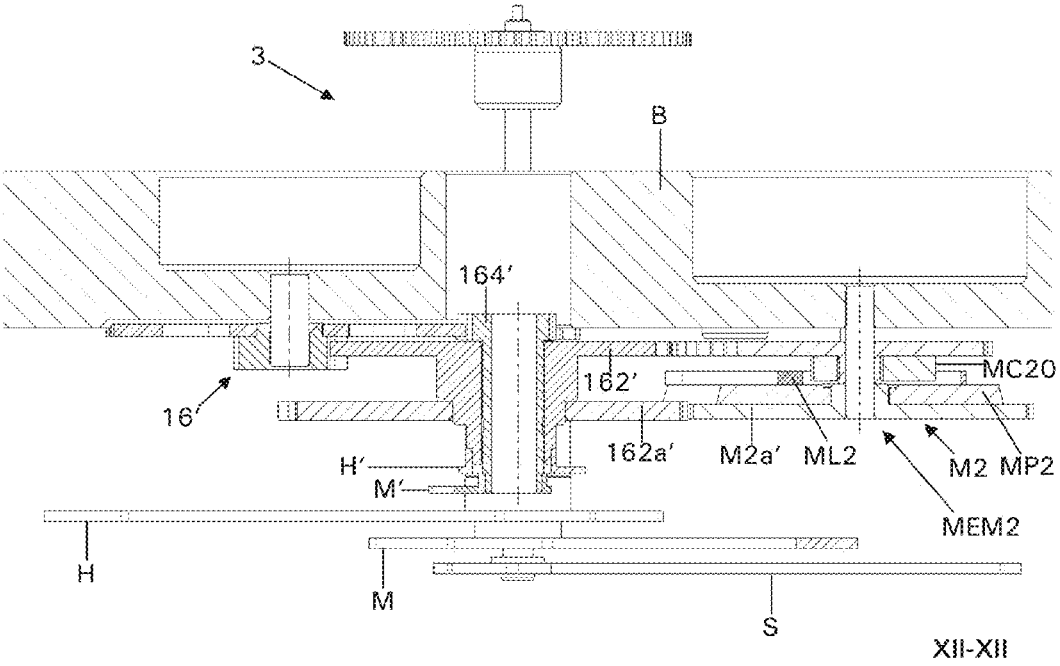
FIG. 12 is a view in section on XII-XII of FIG. 10 of the embodiment of the clock mechanism according to the invention.

Advantageously, the second storage mobile M2 is positioned on the opposite side of the movement frame from the side on which the first storage mobile M1 is situated, as indicated in FIGS. 5, 11, 12.

The structure of the second storage mobile M2 is analogous to that of the mobile M1. The second mobile M2 comprises a wheel M2*a* on which a cam MC20, notably a heart piece, is mounted. This wheel M2*a* is in mesh, notably in continuous mesh, with an hours wheel 162 on which the hours display member H is mounted, notably on which an hours hand H is driven in. The second mobile M2 also comprises a wheel M2*a*' which drives the stored hours wheel 162' via a wheel platform 162*a*' which is mounted thereon. The kinematic connection between the stored hours wheel 162', on which the stored hours display member is mounted, notably on which a hand H' is driven in, and the cannon pinion 164' secured to the stored minutes display member M' is for its part achieved through the intermediary of the auxiliary motion-work 16' the structure of which is identical to that of the motion-work 16.

An immobilizing device B2 is devoted to the storage mobile M2. The immobilizing device B2 is similar to the immobilizing device B1. Just like the immobilizing device B1, the immobilizing device B2 comprises at least one lever or clamp, preferably two levers or clamps P2 and P20 and a spring R2. This immobilizing device is also operated by a control cam C2, for example a column wheel. The display and storage mechanism comprises the immobilizing device B2. The mechanism 3 comprises the control cam C2 that operates the second storage device.

Figure 14:
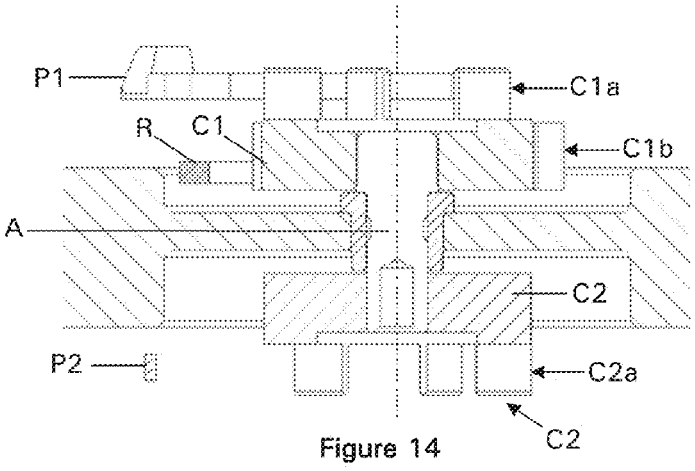
FIG. 14 is a view in cross section of a mechanical connection between the first and second storage parts of the embodiment of the clock mechanism according to the invention.

In order to synchronize the control of the stored hours and minutes display members H' and M' and the stored seconds display member S', the control cam C2 has the specific feature of rotating as one with the control cam C1 through the agency of an arbor A which passes right through the frame B of the movement 2 of the timepiece 1, as indicated in FIG. 14. For preference, a geometric feature GA of the arbor A is designed to collaborate with a complementary or substantially complementary geometric feature GC2 of the control cam C2 to make the angular indexing of the control cam C2 relative to the control cam C1 easier. Thus, the first control cam C1 and the second control cam C2 are connected by an arbor A.

Figure 13:
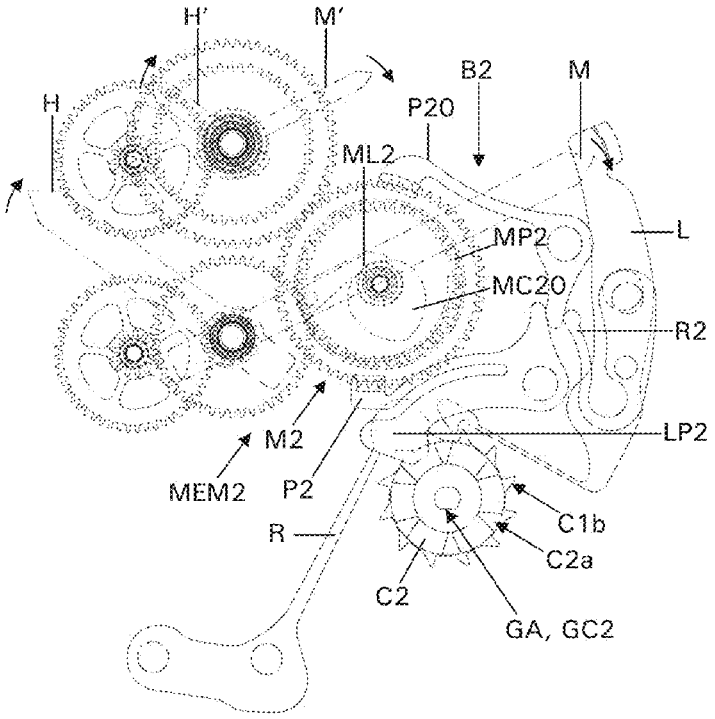
FIG. 13 is a plan view of a second storage part of the embodiment of the clock mechanism according to the invention, the mechanism being in a first configuration of measuring time with hands for indicating the stored hours and minutes.

In the configuration of FIG. 13, the control cam C2 is positioned in such a way that the immobilizing device B2 has no purchase on the storage mobile M2. More particularly, one end of an arm LP2 of the clamp P2 lies facing one of the hollows of the profile C2*a* so that the spring R2 positions the clamps P2 and P20 out of range of the plate MP2. Thus, the head of the return lever ML2 continuously bears against the shoulders or the hollow or the flat formed on the profile of the cam MC20, which means that the set of members H' and M' for displaying the stored hours and minutes and the set of members H and M for displaying the hours and minutes are synchronized.

Figure 15:
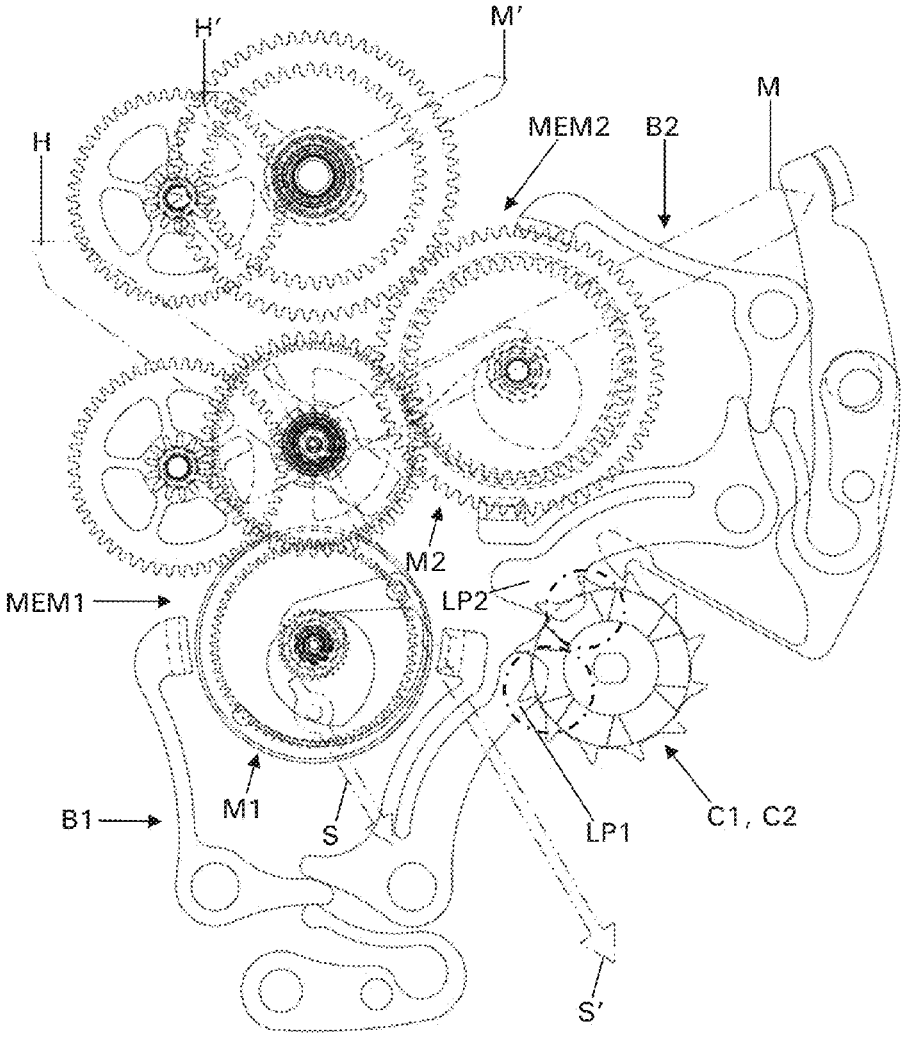
FIG. 15 is an overall plan view of the embodiment of the clock mechanism according to the invention, the mechanism being in a first configuration of measuring time with hands for indicating the stored hours, minutes and seconds.

The configuration illustrated in FIGS. 13 and 15 coincides with that illustrated in FIG. 8. In other words, when the clamp P2 is lying facing one of the hollows of the profile C2*a* of the control cam C2, the clamp P1 is also situated facing one of the hollows of the profile C1*a* of the control cam C1. The immobilizing devices B1 and B2 are thus synchronized, which means that the immobilizing of the members that display the stored hours, minutes and seconds is synchronized.

Just as with the control cam C1, action on the control member O causes the control cam C2 to rotate so that one of the columns of the profile C2*a* drives the clamps P2 and P20 against the action of the spring R2 so that they can immobilize the rotation of the plate MP2 of the mobile M2. Thus, in the configuration of FIGS. 16 and 17, the lever ML2 is immobilized in a well defined angular position of the plate MP2, while the cam MC20 continues to turn. This situation results in the members H' and M' that display the stored hours and minutes becoming immobilized while the members H and M that display the hours and minutes continue on their way.

Figure 16:
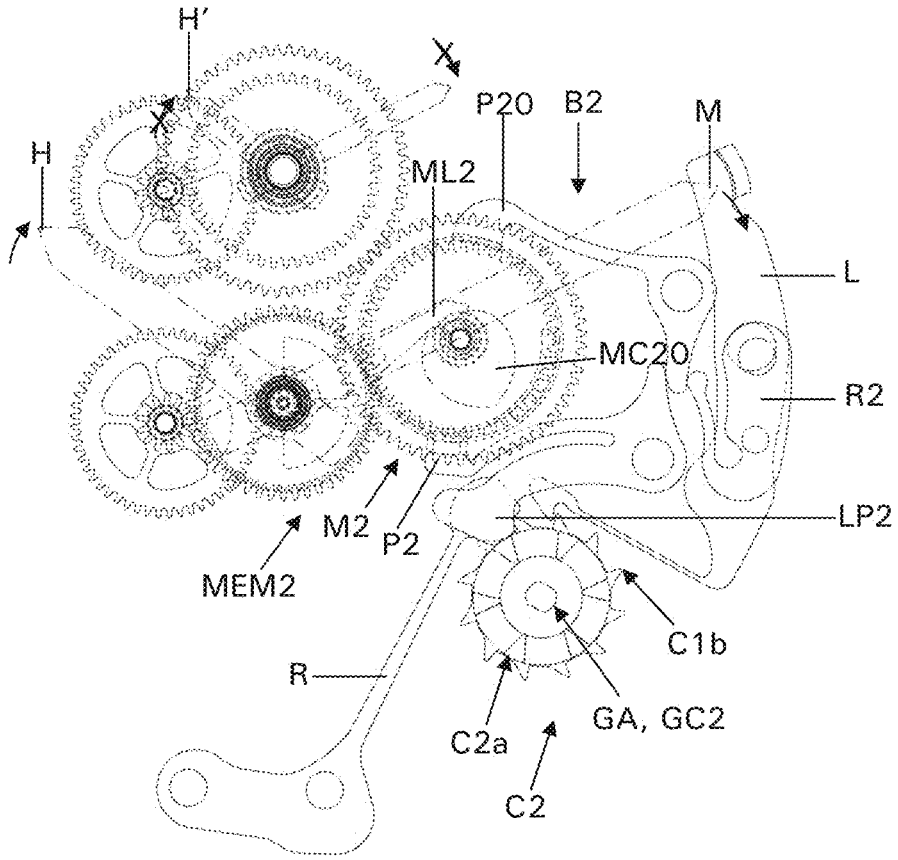
FIG. 16 is a plan view of the second storage part of the embodiment of the clock mechanism according to the invention, the mechanism being in a first configuration of measuring time with hands for indicating the stored hours and minutes.
Figure 17:
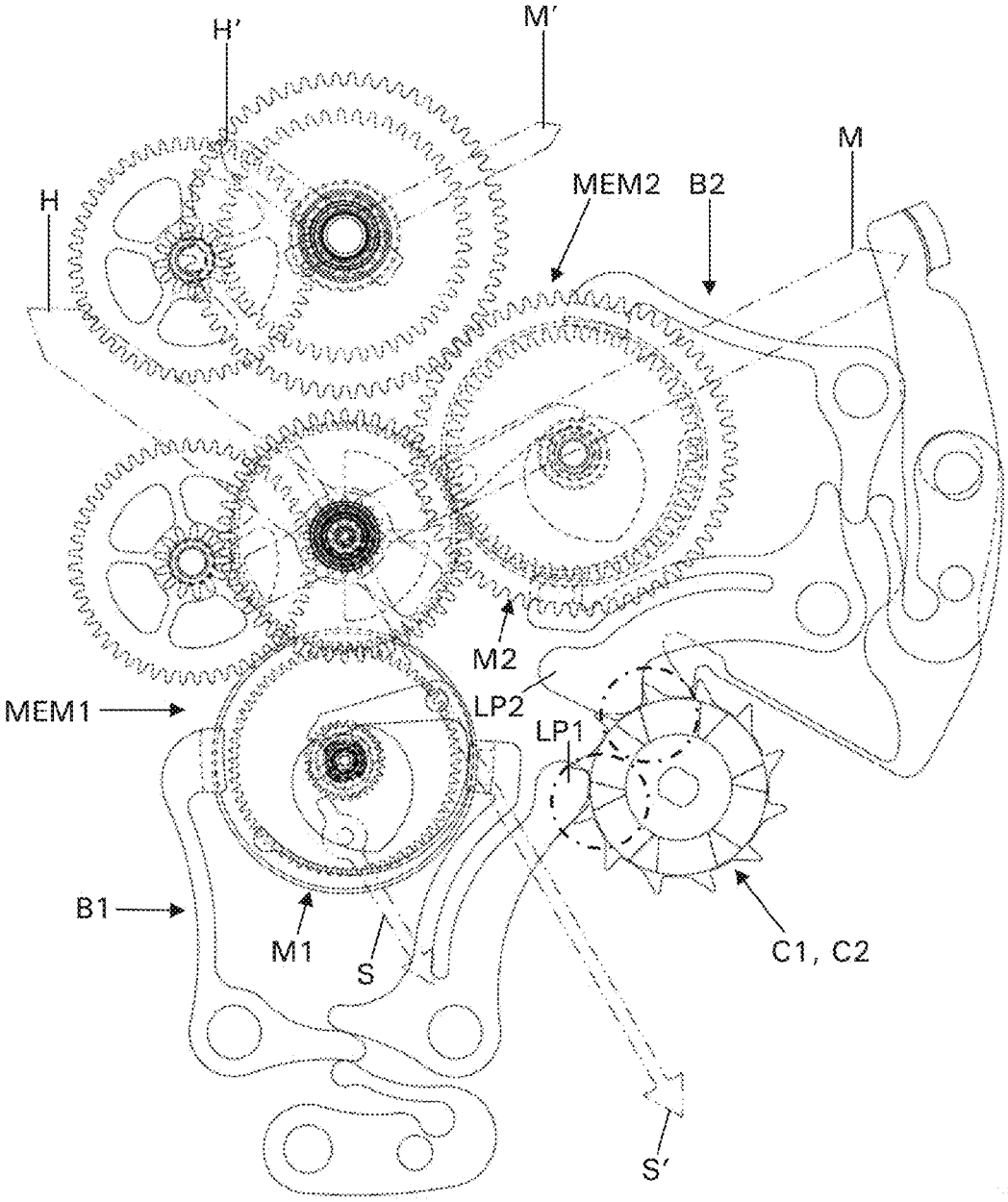
FIG. 17 is an overall plan view of the embodiment of the clock mechanism according to the invention, the mechanism being in a second configuration of storing time with hands for indicating the stored hours and minutes.

This configuration illustrated by FIGS. 16 and 17 coincides with that illustrated by FIG. 9. In other words, when the clamp P2 is situated facing one of the columns of the profile C2*a* of the control cam C2, the clamp P1 is likewise situated facing one of the columns of the profile C1*a* of the cam C1. The immobilizing devices B1 and B2 are thus synchronized, which means that the stopping of the members H', M' and S' that display the stored hours, minutes and seconds is synchronized.

Of course, the profiles C1*a*, C2*a* of the respective cams C1, C2 can be configured differently if the immobilizing devices B1, B2 have distinct modes of operation. In all events, the cams C1 and C2 are defined in such a way as to synchronize the immobilizing devices B1, B2 so as to synchronize the stopping of the members H', M' and S' that display the stored hours, minutes and seconds.

By virtue of the invention, the first storage mobile M1 is in direct mesh with the seconds mobile of the geartrain. This storage mobile is controlled by the first immobilizing device B1.

The second storage mobile M2 allows for the storage of the hours and/or the minutes. It is in direct mesh with the motion-work of the basic movement. This storage mobile is controlled by at least one second immobilizing device B2.

The control cams C1, C2 are designed to operate each of the immobilizing devices B1, B2. They are actuated through the agency of the control member O which transmits the actions that the user applies to the display and storage mechanism 3, to the movement 2 or to the timepiece 1.

The control cams C1, C2 are able to turn. They are configured to be positioned on either side of the frame B of the timepiece 1 so as to operate the at least two immobilizing devices B1, B2.

The seconds mobile 12 is, for example, positioned on a first side of the frame B of the movement, while the motion-work is conventionally positioned on the other side of the frame of the movement as indicated in FIG. 11.

As indicated in FIG. 11, the mechanism 3 has a median plane P3 parallel to the plane PB of the frame B of the movement. The median plane P3 is substantially perpendicular to the arbor A and to the mobile 12' and divides the space into two parts of the same volume in which parts the entire mechanism 3 is contained. The plane PB of the frame divides the plate of the movement into a first part and a second part of substantially equal bulk. The first storage device MEM1, particularly the storage mobile M1 and/or the first storage element MC1 and/or the plate MP1, is in the first part. The second storage device MEM2, particularly the storage mobile M2 and/or the first storage element MC2 and/or the plate MP2, is in the second part.

The display and storage mechanism comprises members for displaying the time and for storing a moment preferably situated within a 12-hour or even 24-hour range. For preference, the members for displaying the time and the storage members move at the same rate through the same time range. Alternatively, the hands that display the time and those used for storage indicate information on two separate time ranges.

Thus, according to the invention, for each of the time or timing, hours and/or minutes and/or seconds information items, the mechanism has the specific feature of selectively indicating the stored information or the current information using one and the same display member under the action of a single control member. Such a mechanism may for example prove useful for marking the time at the start of an event and indicating to within a second the time at which it finishes.

A positioning of display members in one or more random positions or in one or more positions defined once and for all, i.e. in one or more positions that are not user definable or not user modifiable, as it can be found in mechanisms for displaying time information upon request, cannot be considered as a storage within the meaning of the invention.

Throughout this document, "direct mesh" is intended to mean any kinematic connection with no clutch device. Preferably, the connection is permanent. It is possible if appropriate for one or more intermediate elements to be arranged between the seconds wheel and the storage mobile.

The invention claimed is:

1. A mechanism for indicating and storing time information, the mechanism comprising:

at least one of an hours display member for displaying hours, a minutes display member for displaying minutes, and a seconds display member for displaying seconds, at least one of a stored hours display member for displaying stored hours and a stored minutes display member for displaying stored minutes, a stored seconds display member for displaying stored seconds, a control element, wherein at least one of the stored hours display member, the stored minutes display member and the stored seconds display member has (i) a first position displaying the current time information and (ii) a second position displaying the stored time information, and wherein the mechanism is configured to position the at least one of the stored hours display member, the stored minutes display member and the stored seconds display member selectively in the first position or the second position, upon an action on the control element.

2. The mechanism as claimed in claim 1, in which the mechanism comprises a first storage device for storing the seconds and at least a second storage device for storing at least one of the minutes and the hours.

3. The mechanism as claimed in claim 2, in which at least one of (i) the first storage device comprises a first storage mobile provided with a first storage element adapted to be in mesh with a first portion of a first geartrain devoted to said first storage mobile, and (ii) the second storage device comprises a second storage mobile provided with a second storage element adapted to be in mesh with a second portion of a second geartrain devoted to said second storage mobile.

4. The mechanism as claimed in claim 2, wherein at least one of (i) the first storage device comprises a first immobilizing device, and (ii) the second storage device comprises a second immobilizing device.

5. The mechanism as claimed in claim 4, wherein at least one of (i) the first immobilizing device comprises at least a first clamp or a first lever, and (ii) the second immobilizing device comprises at least a second clamp or a second lever.

6. The mechanism as claimed in claim 2, wherein the control element operates the first storage device and the second storage device.

7. The mechanism as claimed in claim 6, wherein the control element comprises:

a first cam for operating the first storage device; and a second cam for operating the second storage device.

8. The mechanism as claimed in claim 7, wherein the first cam and the second cam are connected by an arbor.

9. The mechanism as claimed in claim 8, wherein the first cam and the second cam are fixed together by an arbor.

10. The mechanism as claimed in claim 7, wherein at least one of (i) the first cam comprises a first column wheel and (ii) the second cam comprises a second column wheel.

11. The mechanism as claimed in claim 10, wherein the first cam or the first column wheel and the second cam or the second column wheel are fixed together by an arbor.

12. A clock movement comprising a mechanism as claimed in claim 2, wherein a first storage element is in mesh with an element of a first geartrain of the clock movement or fixed to an element of a geartrain of the clock movement, and a second storage element is in mesh with an auxiliary geartrain of the clock movement.

13. The clock movement as claimed in claim 12, wherein the first storage element is in mesh with the first geartrain element which is a seconds wheel.

14. The clock movement as claimed in claim 12, wherein at least one of (i) the first storage element is a cam, and (ii) the second storage element is a cam.

15. The clock movement as claimed in claim 12, wherein the mechanism has a median plane parallel to a plane of a frame of the clock movement and dividing the clock movement into a first part and a second part of substantially equal bulk, and wherein the first storage device is in the first part and the second storage device is in the second part.

16. The clock movement as claimed in claim 15, wherein a first cam and a second cam are positioned on either side of the median plane.

17. A timepiece comprising a movement as claimed in claim 12.

18. The mechanism as claimed in claim 2, wherein at least one of the first storage device and the second storage device comprises a synchronization element for synchronizing at least one of the stored seconds, minutes, and hours display members with at least one respective one of the seconds, minutes, and hours display members.

19. The mechanism as claimed in claim 1, wherein the mechanism allows at least one of a 12 hour display and a 24 hour display.

20. The mechanism as claimed in claim 1, wherein at least one of the stored minutes display member and the stored hours display member is configured to allow a storage capacity greater than 30 minutes.

21. A timepiece comprising a mechanism as claimed in claim 1.

22. The mechanism as claimed in claim 1, wherein the mechanism is of a mechanical type.

23. The mechanism as claimed in claim 1, wherein the mechanism is a flyback mechanism.

24. The mechanism as claimed in claim 1, wherein the stored time information is an instantaneous time information displayed by at least one of the hours display member, the minutes display member, and the seconds display member at an instant of storage.

25. A mechanism for indicating and storing time information, the mechanism comprising:

at least one of an hours display member for displaying hours, a minutes display member for displaying minutes, and a seconds display member for displaying seconds, a first geartrain actuating at least one of the hours, minutes, and seconds display members, at least one of a stored hours display member for displaying stored hours and a stored minutes display member for displaying stored minutes, a stored seconds display member for displaying stored seconds, a first storage device for storing the seconds, the first storage device comprising a first storage mobile and a first storage element, wherein the first storage device has (i) a first position in which the first storage device is kinematically linked to the first geartrain, by being in mesh with the first geartrain, and (ii) a second position in which the first storage device is not kinematically linked to the first geartrain, and a second storage device for storing at least one of the minutes and the hours, the second storage device comprising a second storage mobile and a second storage element, wherein the second storage device has (i) a first position in which the second storage device is kinematically linked to the first geartrain, by being in mesh with the first geartrain, and (ii) a second position in which the second storage device is not kinematically linked to the first geartrain.

* * * * *